US005899442A

United States Patent [19]

Meglino et al.

[11] Patent Number: 5,899,442

[45] **Date of Patent: * May 4, 1999**

[54] PRIVACY INSERTS FOR CHAIN LINK FENCES

[76] Inventors: Don A. Meglino; James V. Meglino, both of 100 Frank Rd., Hicksville, N.Y. 11802

[ * ] Notice: This patent is subject to a terminal disclaimer.

[21] Appl. No.: 08/766,432

[22] Filed: Dec. 12, 1996

Related U.S. Application Data

[63] Continuation-in-part of application No. 08/592,073, Jan. 26, 1996, Pat. No. 5,584,468.

[51] Int. Cl.[6] ..... B21F 27/00

[52] U.S. Cl. ..... 256/32; 256/1; 256/34

[58] Field of Search ..... 256/24, 32, 34, 256/45, 49, 50, 1, 13.1

[56] References Cited

U.S. PATENT DOCUMENTS

| | | | |
|---|---|---|---|
| 2,372,868 | 4/1945 | Warren, Jr. | 256/13.1 X |
| 2,382,355 | 8/1945 | Warren, Jr. | 256/13.1 X |
| 2,742,391 | 4/1956 | Warp | 256/19 |
| 3,404,526 | 10/1968 | Thomas | 256/13.1 X |
| 4,113,681 | 9/1978 | Harmuth | 260/28.5 D |
| 4,602,765 | 7/1986 | Loper et al. | 256/19 |
| 4,706,712 | 11/1987 | Oglesby et al. | 138/126 |
| 4,860,998 | 8/1989 | Snyder | 256/34 |
| 4,964,618 | 10/1990 | Kennedy et al. | 256/24 |
| 5,007,619 | 4/1991 | Sibeni | 256/34 |
| 5,106,058 | 4/1992 | Finkelstein | 256/32 X |
| 5,148,836 | 9/1992 | Lawrence | 138/121 |
| 5,184,801 | 2/1993 | Finkelstein | 256/32 X |
| 5,275,380 | 1/1994 | Barsby | 256/34 |
| 5,275,381 | 1/1994 | Cluff et al. | 256/34 X |
| 5,395,092 | 3/1995 | McLaughlan et al. | 256/32 X |
| 5,402,988 | 4/1995 | Eisele | 256/24 |
| 5,584,468 | 12/1996 | Meglino et al. | 256/32 X |
| 5,609,327 | 3/1997 | Amidon | 256/24 |
| 5,687,957 | 11/1997 | Finkelstein | 256/34 |
| 5,775,676 | 7/1998 | Hoggan | 256/34 |
| 5,806,839 | 9/1998 | Meglino | 256/34 |

*Primary Examiner*—Daniel P. Stodola
*Assistant Examiner*—Bruce A. Lev
*Attorney, Agent, or Firm*—Galgano & Burke

[57] ABSTRACT

Privacy fence inserts for chain link fences and assemblies comprising a chain link fence and a plurality of fence inserts wherein portions of the fence inserts comprise an inner core and an outer layer comprising a material which is different from said outer layer. One preferred embodiment comprises a central tubular portion and lateral wing members.

21 Claims, 3 Drawing Sheets

PRIVACY INSERTS FOR CHAIN LINK FENCES

RELATED APPLICATION

This application is a continuation-in-part of application Ser. No. 08/592,073, filed Jan. 26, 1996, which issued as U.S. Pat. No. 5,584,468 on Dec. 17, 1996.

The present invention is directed to privacy inserts for chain link fences and, more particularly, to fence inserts comprising an inner core comprising a first material and an outer layer substantially surrounding the core comprising a second material.

BACKGROUND OF THE INVENTION

Chain link fences have been widely used for many years to satisfy fencing requirements. While they provide acceptable strength and durability over many years, they do not provide privacy or serve as a windbreak due to their appertured construction. Various inserts, typically referred to as "slats", have been suggested and manufactured for increasing the privacy of a chain link fence, as well as serving as a windbreak. Many early arrangements were designed to be directly connected to the wire of the fence and required clamping or bending of a metal slat onto a link of the fence.

One inventor of the present invention overcame a problem with slats migrating upwardly and downwardly due to wind or other environmental forces, which created an unfinished uneven appearance, by providing a slat retaining means which extended through a slot in the slats and is described in U.S. Pat. No. 4,512,556 to Meglino which issued on Apr. 23, 1985.

Those skilled in the art appreciate that one of the major costs incurred in the manufacture of privacy inserts is the cost of the raw materials. It would therefore be desirable to provide a readily fabricated fence insert which is less expensive than previous designs without lowering the aesthetic standards of the insert.

It is also desirable to provide an aesthetically pleasing fence insert which is readily installed into an existing chain link fence, and which has sufficient structural integrity to withstand adverse weather conditions typically encountered by a chain link fence.

SUMMARY OF THE INVENTION

The various embodiments of the present invention provide a privacy fence insert for chain link fences and a system comprising a chain link fence and a plurality of fence inserts wherein the fence inserts comprise at least two different materials.

One embodiment of the present invention comprises a fence insert comprising an inner, relatively rigid hollow core and an outer resilient layer. Another embodiment of the invention comprises fence inserts comprising a central portion formed of a first material having a substantially tubular cross-section and a substantially enclosing second portion comprising laterally extending wings.

A still further embodiment comprises a fence insert having at least three layers wherein at least two, preferably three, of the layers comprised different materials.

According to still another embodiment of the present invention, opposing wings are positioned in an offset manner such that the wing on one side of the central portion is disposed more forwardly of the wing on the opposing side of the central portion.

According to still yet another preferred embodiment of the present invention, the opposing wings of a fence insert have a substantially triangular cross-section. According to a further embodiment of the present invention, the laterally extending wings of a fence insert are provided with serrated edges in order to facilitate insertion of the fence insert into a chain link fence and retention therein.

These and other embodiments of the present invention are described below with reference to the Figures.

DETAILED DESCRIPTION

The various embodiments of the present invention are designed to increase the structural integrity of fence inserts and/or reduce the overall cost of such fence inserts. The various embodiments of the present invention each comprise an inner core and a layer disposed in substantially surrounding relationship to the outer surface of the core. The inner core is most preferably hollow, however it is within the scope of the present invention to include one or more supports or to form a solid inner core. In some of the illustrated embodiments, the inner core increases the structural integrity of the fence insert and thereby enhances insertion of the fence insert into a chain link fence. In preferred embodiments, the inner core is fabricated from a low cost material thereby reducing the overall cost of the fence insert. For example, it is within the scope of the present invention to form the inner core of a low cost recycled polymeric material or of a material which does not have sufficient weather-resistent properties to satisfy the material requirements of a fence insert. However, by substantially enclosing the outer surface of the inner core with a second material, the overall cost of the fence insert can be significantly reduced.

Figure 1:
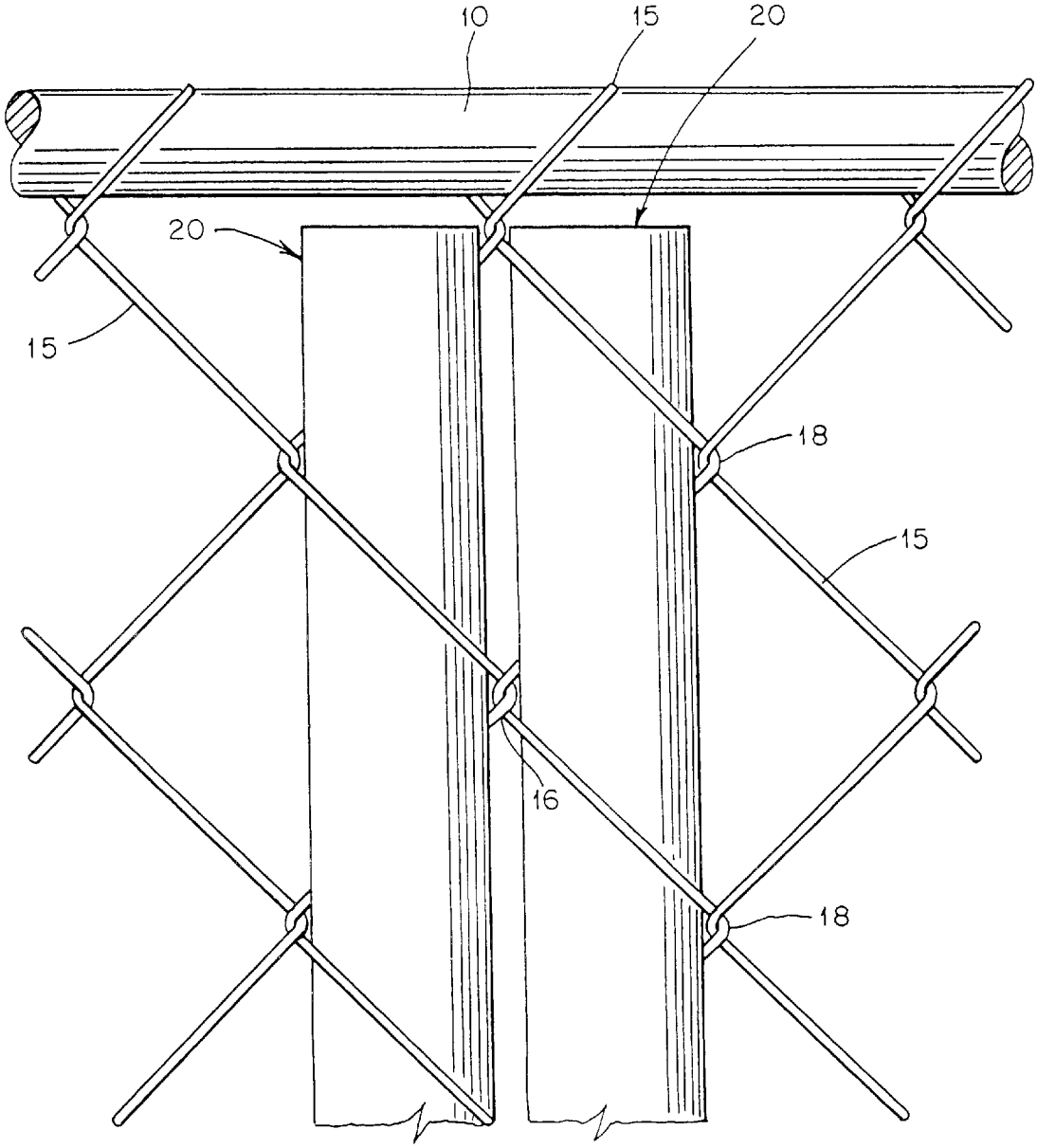
FIG. 1 is a elevational view of one embodiment of the present invention.
Figure 2:
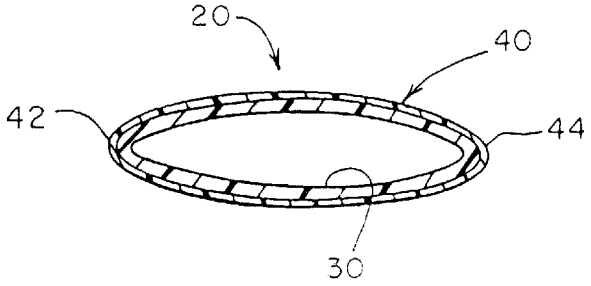
FIG. 2 is an enlarged cross-sectional view of one fence insert shown in FIG. 1.

One embodiment of the present invention is illustrated in FIGS. 1 and 2 wherein two fence inserts 20 are shown inserted into a chain link fence comprising a support bar 10 and interwoven links 15. According to this embodiment of the present invention, a fence insert 20 comprises an elongate tubular portion having a generally elliptical cross-section. The interior of each fence insert 20 comprises an inner core 30 to increase the structural integrity of the fence insert while an outer substantially surrounding layer 40 provides an aesthetically pleasing appearance. According to this preferred embodiment of the present invention, each fence insert 20 is advantageously shaped to span across a channel formed between adjacent interwoven links 15, i.e., rounded surface edges 42 and 44 of fence insert 20 are disposed adjacent knuckles 16 and 18 of the interwoven links 15.

The inner core 30 is preferably fabricated from a substantially rigid material such as a high-density polymeric material. Desirably, inner core 30 is fabricated from low cost recycled material, i.e., recycled polyethylene, recycled polypropylene or combinations thereof. The outer layer 40 is preferably fabricated from substantially resilient materials. Desirably, outer layer 40 is fabricated from a substantially resilient low-density polymeric material or materials, i.e., virgin polyethylene, virgin polypropylene or combinations thereof. Advantageously, the material or materials chosen for fabricating outer layer 40 can provide fence inserts having one or more desired colors.

In contrast to a fence insert fabricated solely from resilient low-density material throughout, the use of a combination of high-density and low-density materials used in the embodiment described above reduces the overall amount of material required for fabricating a fence insert. Specifically, for fence inserts having the same outer surface configuration and stiffness, a fence insert fabricated solely from resilient low-density material necessarily requires a greater wall thickness for the same structural stiffness.

As shown in FIG. 2, inner core 30 preferably comprises a relatively greater wall thickness that outer layer 40. Advantageously, this configuration provides a cost savings when low cost recycled materials are used for the inner core 30 and where generally higher costing, more aesthetically pleasing materials are used for the outer layer. Although, it is preferred that the wall thickness of the inner core is greater than the wall thickness of the outer layer, other configurations are possible, e.g., the wall thickness of the outer layer can be greater than the wall thickness of the inner core, or both wall thicknesses can be the same. In addition, although the wall thickness of the inner core and outer layer are shown to be constant, the thickness need not be constant and can instead vary, e.g., the outer layer can be thinner along the large generally flatter surfaces of the inner core and thicker near the round side edges. Furthermore, the outer layer need not cover all of the outer surface of the inner core, e.g., the outer layer need not cover the top and bottom edges of the fence insert or the inside of the inner core. Also, the outer layer need only cover that portion of the inner core which is to be viewed when installed as a fence insert in a chain link fence. According to one preferred embodiment of the present invention, a fence insert can be formed by coextruding the two materials to form the inner core and outer layer in one step.

Figure 3:
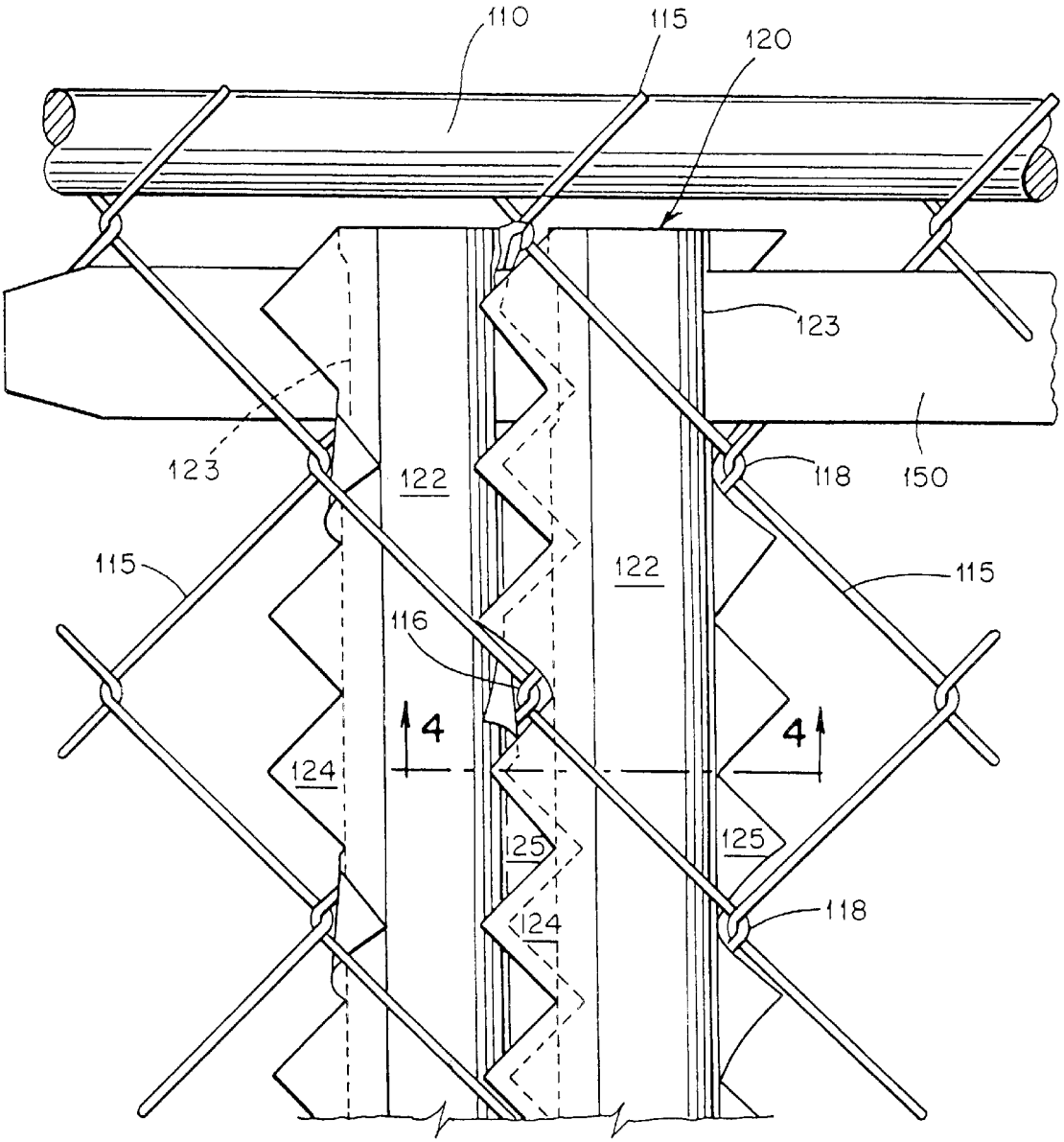
FIG. 3 is a elevational view of an alternative embodiment of the present invention.
Figure 4:
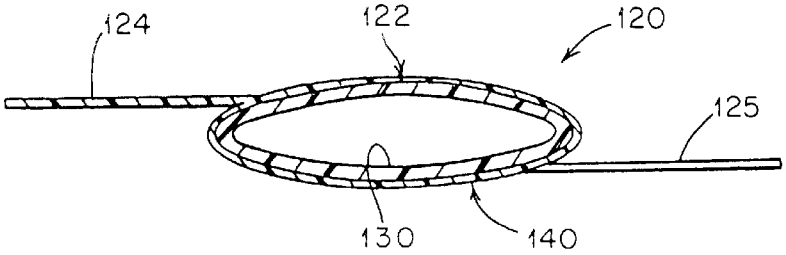
FIG. 4 is an enlarged cross-sectional view of one fence insert shown in FIG. 3.

FIGS. 3 and 4 illustrate another preferred embodiment of the present invention wherein two fence inserts are positioned within a chain link fence comprising a support bar 110 and interwoven links 115. According to this embodiment of the present invention, a fence insert 120 comprises a central tubular portion 122 having a generally elliptical cross-section and opposing slots 123 for receiving a retaining bar 150. Each fence insert also advantageously comprises two opposing wing members 124 and 125 which extend laterally. The wing members 124 and 125 of this embodiment of the present invention are advantageously shaped with offset generally triangular serrated portions which are large enough to overlap with the serrated portions of adjoining fence inserts in order to substantially eliminate the space between adjoining fence inserts 120 typically experienced due to knuckles 116 and 118.

Central tubular portion 122 comprises an inner core 130 and an outer layer 140. Like the earlier embodiment, the inner core 130 is preferably fabricated from a substantially rigid material such as a high-density polymeric material. The outer layer 140 is preferably fabricated from a substantially resilient material and also forms wing members 124 and 125.

As shown more clearly in FIG. 4, opposing wing members 124 and 125 of fence insert 120 of this embodiment of the present invention are offset so that wing member 124 is disposed more forwardly than the opposing wing member 125. In this manner, wing members of neighboring slats are less likely to abut along their edges and will more readily overlap without interfering with each other. According to this preferred embodiment of the present invention, the opposing wing members extend outwardly from the generally tubular central portion 122 at a position between the middle and forward/rearward sides of the central tubular portion 122. It is appreciated that wing members 124 and 125 can be formed essentially along imaginary lines tangent to the forward and rearward sides of the central tubular portion 122. In such embodiments of the present invention, the wing members of neighboring slats will be positioned slightly further apart and therefore have even less of a tendency to abut after insertion into a chain link fence.

Figure 5:
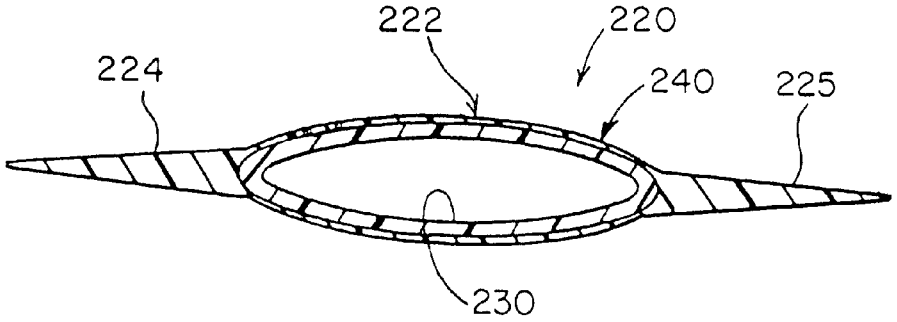
FIG. 5 is a cross-sectional view of an alternative embodiment of a fence insert.

FIG. 5 shows another preferred embodiment of the present invention for a fence insert 220 in which the opposing wing members 224 and 225 extend from the central tubular portion 222 at a position midway between the forward and rearward sides of the central tubular portion 222. In the illustration shown in FIG. 5, an outer layer 240 substantially surrounds an inner core 230 to securely retain wing members 224 and 225 to inner core 230. Since outer layer 240 substantially surrounds the inner core 230, the wing members 224 and 225 will be more securely fastened to the central tubular portion 222 than if the wing members, which are formed of a material different from the inner core 230, had simply been coextruded with that inner core 230. This embodiment eliminates the concern of finding two polymeric materials which would be sufficiently chemically compatible that the wing members are not stripped from the central portion when the fence insert is slid down through the openings of a fence. In this illustrated embodiment, the wing members are preferably triangular in cross-section.

Figure 6:
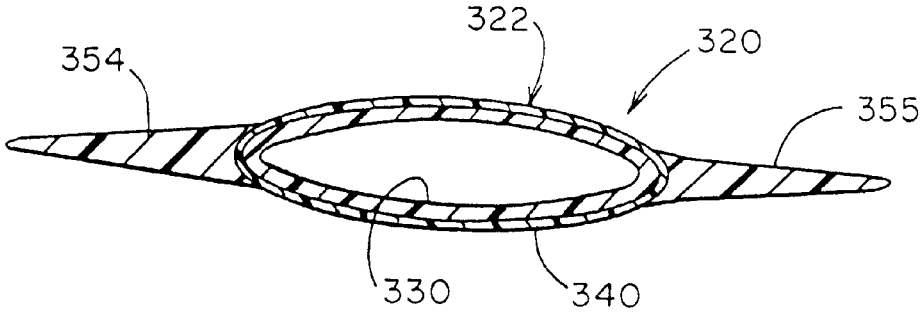
FIG. 6 is a cross-sectional view of still another embodiment of a fence insert.

FIG. 6 shows still another preferred embodiment of the present invention for a fence insert 320 in which the opposing wing members 354 and 355 extend from the central tubular portion 322 at a position midway between the forward and rearward sides of the central tubular portion 322. In this illustrated embodiment, opposing wing members 354 and 355 comprise a third material. Specifically, an outer layer 340 substantially surrounds an inner core 230 and wing members 354 and 355 attach to outer layer 340. The wing members 354 and 355 may have a different color than outer layer 340 so as to provide stripes or a shading effect running along the length of the fence insert. Advantageously, the illustrated fence insert can be formed by coextruding three separate materials so as to form the inner core, the outer layer and the wing members in one step.

Figure 7:
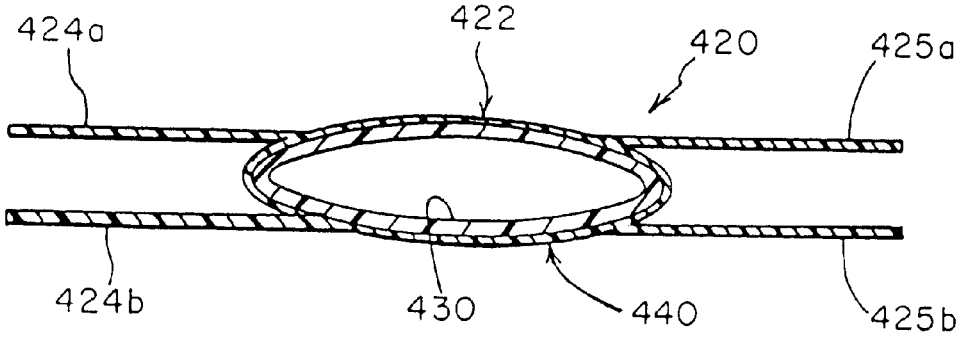
FIG. 7 is a cross-sectional view of still yet another embodiment of a fence insert.

FIG. 7 shows still yet another preferred embodiment of the present invention for a fence insert which includes four wing members 424*a*, 424*b*, 425*a* and 425*b*. In this illustrated embodiment, wing members 424*a* and 424*b* extend from one side of a central tubular portion 422 and wing members 425*a* and 425*b* extend from the opposite side of the central tubular portion 422. Although, the wing members are shown to be in line and parallel, it is appreciated that other configurations would be equally suitable, e.g., the wing members on each side can be angled toward or away from each other.

While the wing members of illustrated embodiments of the present invention extend away approximately equal distances from the central tubular portion, it is within the scope of the present invention to form opposing projecting side portions having different lengths. In addition, although the wing members are preferably triangular in cross-section, other cross-sections are equally suitable, e.g., rectangular or curved. It is further appreciated that the fence inserts of the present invention can include non-serrated side portions so that a fence insert generally spans between the knuckles in the chain link fence. In addition, the wing members can be advantageously provided with slits in order to increase the resiliency of the wings so as to facilitate insertion of the fence insert in a fence.

The illustrated embodiments comprise substantially hollow central portions having generally elliptical cross-sections. While this shape is presently believed to be the preferred configuration, a generally tubular central portion is not necessary in order to enjoy the advantages of the present invention which can be realized with tubular central portions having cross-sections of different shapes, as well as central portions which are non-tubular. It is presently believed that the illustrated shape is preferred since a tubular shape has inherent resiliency which helps to maintain the fence inserts in position after they are inserted into a chain link fence. The illustrated shape also advantageously provides the same appearance on both sides of the fence and fills substantially the entire opening formed by the links thereby avoiding rattling of the inserts (FIG. 3) during windy conditions.

According to another embodiment of the present invention, each fence insert can be provided with more than two, opposing wings. For example, one side of the fence insert can be provided with two laterally extending wings while the other side is provided with a single, laterally extending wing.

Still another embodiment of the present invention, comprises a layer, preferably fabricated with an ultra violet ("UV") retardant additive material, disposed in a substantially surrounding relationship to the outer surface of an inner core. The inner core is most preferably fabricated from a low cost material rather than a more expensive material that includes a UV retardant additive.

For example, in FIGS. 1 and 2, desirably the inner core 30 is fabricated from low cost recycled material, i.e., recycled polyethylene, recycled polypropylene or combinations thereof. Preferably, outer layer 40 contains a UV retardant additive. By substantially enclosing the outer surface of inner core 30, fabricated from low cost material, with outer layer 40, fabricated from UV retardant material, the overall cost of the fence insert can be significantly reduced.

Those skilled in the art will appreciate that harmful UV rays cause deterioration of the fence slat material. The slats can warp and/or crack significantly shortening the useful life of the slat. Advantageously, a fence slat comprised of a UV retardant additive may prevent damage caused by harmful UV rays. The UV retardant additive aids in protection of the fence slat from warping and cracking. The result is a fence slat with longer life and improved effectiveness. In turn, a substantial cost will be saved because the need to replace the fence slat will be less frequent.

What is claimed is:

1. A fence insert comprising:

a substantially elongate core comprising a first material, said core comprising a first face portion, a second face portion, said face portions extending generally along a major axis of said core, a first side portion and a second side portion, said side portions extending generally along a minor axis of said core;

at least one wing member attached to one of said side portions;

at least one outer layer substantially covering said first face portion and said second face portion, said at least one outer layer comprising a second material which is different from said first material.

2. A fence insert according to claim 1 wherein said first material and said second material comprise different densities.

3. A fence insert according to claim 1 wherein said first material and said second material are different polymeric materials.

4. A fence insert according to claim 1 wherein said first material is a high-density polymeric material.

5. A fence insert according to claim 1 wherein said second material is a low-density polymeric material.

6. A fence insert according to claim 1 wherein said core is substantially hollow.

7. A fence insert according to claim 1 further comprising a third material connected to said outer layer, wherein said third material is different from at least one of said first material or said second material.

8. A fence insert according to claim 1 wherein said outer layer and said wing member are formed of the same material.

9. A fence insert according to claim 8 wherein said fence insert further comprises at least two lateral wing members.

10. A fence insert according to claim 9 wherein said outer layer and said wing member are differently colored.

11. A fence insert according to claim 9 wherein said wing member is formed of a material different from said outer layer.

12. A fence insert according to claim 1 where said second material comprises a UV retardant additive.

13. A fence insert according to claim 1 wherein said wing member has a generally triangular cross-section.

14. A fence insert according to claim 1 wherein said core and said outer layer are different thicknesses.

15. A fence assembly, for use in a chain link fence having a mesh, comprising:

a plurality of interlocking chain links; and a plurality of fence inserts inserted through said chain links; each of said fence inserts comprising a substantially elongate core comprising first material, said core comprising a first face portion, a second face portion, said face portions extending generally along a major axis of said core, a first side portion and a second side portion, said side portions extending generally along a minor axis of said core, and at least one outer layer disposed substantially around said face portions of said elongate core, said outer layer comprising a second material which is different from said first material.

16. A fence assembly according to claim 15 wherein said first material and said second material have different densities.

17. A fence assembly according to claim 15, wherein said first material and said second material comprise different polymeric materials.

18. A fence assembly according to claim 15, wherein said outer layer further comprises at least one wing member.

19. A fence assembly according to claim 15, wherein said outer layer further comprises at least two wing members.

20. A fence assembly according to claim 15, further comprising at least one lateral wing member attached to said outer layer.

21. A fence assembly according to claim 15 where said second material comprises a UV retardant additive.

* * * * *